US007327247B2

(12) United States Patent
Tice

(10) Patent No.: US 7,327,247 B2
(45) Date of Patent: Feb. 5, 2008

(54) FIRE DETECTION SYSTEM AND METHOD USING MULTIPLE SENSORS

(75) Inventor: Lee D. Tice, Bartlett, IL (US)

(73) Assignee: Honeywell International, Inc., Morristown, NJ (US)

( * ) Notice: Subject to any disclaimer, the term of this patent is extended or adjusted under 35 U.S.C. 154(b) by 339 days.

(21) Appl. No.: 10/997,723

(22) Filed: Nov. 23, 2004

(65) Prior Publication Data

US 2006/0119477 A1 Jun. 8, 2006

(51) Int. Cl.
*G08B 29/00* (2006.01)

(52) U.S. Cl. ..... 340/511; 340/309.16; 340/506; 340/521; 340/628; 340/870.01

(58) Field of Classification Search ..... 340/309.16, 340/511, 506, 521, 522, 539.24, 628, 632, 340/286.05, 870.01, 500
See application file for complete search history.

(56) References Cited

U.S. PATENT DOCUMENTS

| | | | | |
|---|---|---|---|---|
| 4,639,598 | A | 1/1987 | Kern et al. | 250/339 |
| 4,640,628 | A | 2/1987 | Seki et al. | 374/141 |
| 4,727,359 | A | 2/1988 | Yuchi et al. | 340/618 |
| 4,749,987 | A | 6/1988 | Ishii | 340/587 |
| 4,922,230 | A | 5/1990 | Ohtani et al. | 340/577 |
| 5,172,096 | A | 12/1992 | Tice et al. | 340/501 |
| 5,260,687 | A | 11/1993 | Yamauchi | |
| 5,280,272 | A | 1/1994 | Nagashima | |
| 5,483,222 | A | 1/1996 | Tice | 340/518 |
| 5,497,009 | A | 3/1996 | Torikoshi et al. | 250/574 |
| 5,552,763 | A | 9/1996 | Kirby | 340/506 |
| 5,557,262 | A | 9/1996 | Tice | 340/587 |
| 5,612,674 | A | 3/1997 | Tice | 340/517 |
| 5,625,342 | A * | 4/1997 | Hall et al. | 340/578 |
| 5,659,292 | A | 8/1997 | Tice | 340/522 |
| 5,691,703 | A | 11/1997 | Roby et al. | 340/628 |
| 5,726,633 | A | 3/1998 | Wiemeyer | |
| 5,736,928 | A | 4/1998 | Tice | |
| 5,818,326 | A * | 10/1998 | Winterble et al. | 340/286.05 |
| 5,831,524 | A | 11/1998 | Tice | |
| 5,969,604 | A | 10/1999 | Tice | |
| 5,995,008 | A * | 11/1999 | King et al. | 340/578 |
| 6,114,955 | A * | 9/2000 | Brunius et al. | 340/539.24 |
| 6,195,011 | B1 | 2/2001 | Winterble | |
| 6,229,439 | B1 | 5/2001 | Tice | |
| 6,320,501 | B1 | 11/2001 | Tice et al. | |
| 6,597,288 | B2 * | 7/2003 | Amano et al. | 340/628 |
| 6,659,292 | B2 | 12/2003 | Gough | |
| 6,788,198 | B2 * | 9/2004 | Harshaw | 340/522 |
| 6,989,756 | B2 * | 1/2006 | Rhodes et al. | 340/628 |

OTHER PUBLICATIONS

PCT International Search Report—Int'l App. No. PCT/US05/32610; Feb. 20, 2007 (2 pages).
PCT Written Opinion of the International Searching Authority—Int'l App. No. PCT/US05/32610; Feb. 20, 2007 (3 pages).

* cited by examiner

*Primary Examiner*—Davetta W. Goins
(74) *Attorney, Agent, or Firm*—Welsh & Katz, Ltd.

(57) ABSTRACT

Outputs from a plurality of different ambient condition sensors are cross correlated so as to adjust a threshold value for a different, primary, sensor. Cross-correlation processing can be carried out locally in a detector or remotely. To minimize false alarming, the alarm determination can be skipped if the output from the primary sensor does not exhibit at least a predetermined variation from an average value thereof.

26 Claims, 3 Drawing Sheets

BEST AVAILABLE COPY

FIRE DETECTION SYSTEM AND METHOD USING MULTIPLE SENSORS

FIELD OF THE INVENTION

The invention pertains to fire detection systems. More particularly, the invention pertains to detectors for such systems which incorporate multiple sensors of different ambient conditions where some of the sensors are used to modify an alarm threshold associated with another of the sensors.

BACKGROUND OF THE INVENTION

It has been recognized that fires exhibit different types of characteristics as they develop. For example, flaming fires often have very low smoke levels. Such fires need to be detected as soon as possible as they are known to be able to spread at a faster rate than smoldering fires.

Smoldering fires may not spread at the same rate as flaming fires. On the other hand, smoldering fires have been recognized as generators of extensive amounts of smoke which can be quite dangerous.

Various systems have been developed in the past to address these different fire profiles. Representative samples include Tice U.S. Pat. No. 5,557,262 entitled "Fire Alarm System with Different Types of Sensors and Dynamic System Parameters", Tice U.S. Pat. No. 5,612,674 entitled "High Sensitivity Apparatus and Method with Dynamic Adjustment for Noise", and Tice U.S. Pat. No. 6,659,292 entitled "Apparatus Including a Fire Sensor and a Non-Fire Sensor". The noted patents are all assigned to the assignee hereof and incorporated by reference.

While known systems have been effective for their intended purpose, there continues to be a need for systems with faster fire detection, while at the same time, minimizing the likelihood of nuisance alarms. The need to minimize nuisance or false alarms is ongoing, notwithstanding the desirability of faster fire detection.

Systems and methods of fire detection which shorten response times for detection of actual fire conditions while at the same time being flexible enough to minimize the likelihood of false alarms, avoid the inconvenience and economic losses which can be associated with false alarms.

DETAILED DESCRIPTION OF THE EMBODIMENTS

Figure 1:
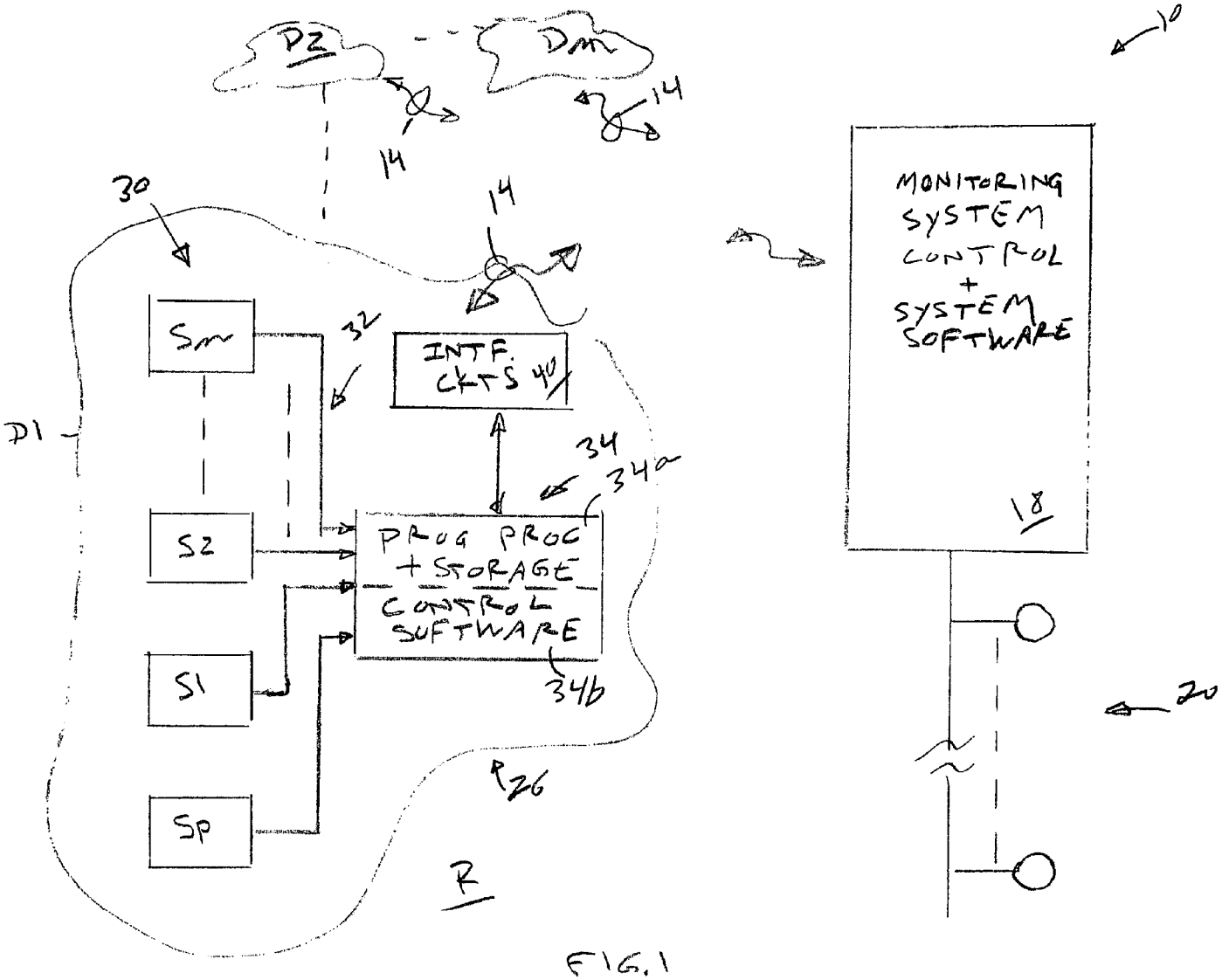
FIG. 1 is a block diagram of a system in accordance with the invention.

While embodiments of this invention can take many different forms, specific embodiments thereof are shown in the drawings and will be described herein in detail with the understanding that the present disclosure is to be considered as an exemplification of the principles of the invention and is not intended to limit the invention to the specific embodiment illustrated.

Systems and methods in accordance with the invention combine different types of sensors, such as smoke sensors and non-smoke sensors (thermal sensors, gas sensors and the like) to maximize sensitivity to fires and minimize the sensitivity to non-fire conditions. A particular sensor type, such as a photoelectric sensor (effective to detect smoke from smoldering fires) can be selected as a primary sensor. One or more additional or secondary sensors such as thermal sensors, gas sensors (for example CO sensors) or infrared sensors or a combination thereof, can be selected as the secondary sensors.

Cross-correlation processing can be used relative to output signals from the secondary sensors so as to establish values which can be used to automatically adjust a threshold value for the primary sensor to reduce the time required to make a determination that the primary sensor is indicating the presence of a fire condition. For example, if the secondary sensors are implemented as a thermal sensor and a carbon monoxide sensor, in the presence of a flaming fire, the output signal from the thermal sensor will increase indicating a rise in temperature. This rise in temperature can be used to contribute to a reduction in threshold value of the primary sensor, thereby shortening the period required for the primary sensor to exhibit an alarm condition.

A smoldering fire will generate smoke and gases with less of an increase in temperature. In this instance, the output from the carbon monoxide sensor can contribute to a reduction in threshold value of the primary sensor, thereby shortening the time interval to alarm for smoldering fires. On the other hand, nuisance sources, cigarette smoke, cooking smoke and the like, may not generate the increases in temperature found in flaming fires nor the increase in carbon monoxide found in smoldering fires thereby contributing to a minimization of nuisance or false alarms.

Preferably, the combined secondary sensor signals will produce a result which exceeds a predetermined value prior to decreasing the alarm threshold for the primary sensor. Alternately, in another aspect of the invention, an infrared sensor, usable for detecting flames at the earliest stages of a fire, can be used to address a threshold value for other secondary sensors before those sensors will be permitted to contribute to the combination.

Where the secondary sensors include an infrared sensor and a thermal sensor, the infrared sensor, in response to detecting flames, can reduce a threshold associated with the thermal sensor enabling it to make a greater contribution to the cross correlated result, which in turn will lower the alarm threshold of the primary, photoelectric sensor.

In a two sensor embodiment, outputs from a primary sensor can be combined with an output signal from a different sensor to form an adjustment value. This adjustment value can be used to alter an alarm threshold of the primary sensor. The primary sensor could be, for example, a photoelectric smoke sensor. The secondary sensor could be, without limitation, a thermal or a gas, such as CO sensor.

As described in more detail subsequently in a disclosed embodiment, the sensors in a multi-sensor detector cooperate together to adjust the fire sensitivity of the detector. This is accomplished by selecting one of the sensors as the primary sensor in the detector and the other sensors as adjusting sensors.

Signals from the other sensors can be used to adjust the alarm threshold for the primary sensor by processing them to establish at least one cross-correlation between at least some of the other sensor signals. This cross-correlation can be established as a sum and/or a multiplication of representations of at least two of the other sensor signals or changes in at least two of the other sensor signals. Alternately, signal values from the primary sensor can be so combined with signal values from a sole secondary sensor.

An exemplary detector contains a photo sensor (P), and at least one, some or all of a thermal sensor (T), a carbon monoxide sensor (CO), and a flame sensor (F). The flame sensor F can be processed as would be understood by those of skill in the art to produce a signal PD which can include the addition of integer numbers. The thermal, T and CO sensors can be processed to produce the signals deltaT and deltaCO respectively as changes or variations from their respective average values.

Where the selected primary sensor is the photo sensor P, a deltaP is computed as the change in P from its average. The variations from respective averages of the other sensor signals (deltaT, deltaCO, and PD) can be used to form an adjustment equation to alter an alarm threshold of the deltaP in determining an alarm condition.

An exemplary adjustment equation can take the form of:

[(OFFSET+(deltaT+deltaCO+deltaT*deltaCO)*PD]

as one of many different forms providing cross-correlation of the other signals. This adjustment equation can be alternately shown to be

[OFFSET+deltaT*PD+deltaCO*PD+
deltaT*deltaCO*PD].

The OFFSET can be a number that is added into the equation to compensate for sensor degrading. If a sensor becomes less sensitive over time, then the value of the OFFSET is increased to compensate for the sensor degrading.

The adjustment equation can be used to alter the alarm threshold for the deltaP signal by dividing that threshold, which can be variable, by the adjustment equation. The alarm determination routine can be expressed as:

IF deltaP> Threshold/(adjustment equation) THEN
OUTPUT=ALARM ELSE OUTPUT=NO
ALARM The Threshold can also be adjustable based upon prior history of the photo (P) sensor signals. It can be automatically adjusted as described in previously incorporated U.S. Pat. No. 5,612,674 or by other methods as would be known to those of skill in the art. In another aspect of the invention, the threshold can be varied by downloading the threshold value(s). Those of skill in the art will recognize that variations of the above identified equations are possible and come within the spirit and scope of the invention.

In yet another aspect of the invention, alarm determination processing will be carried out only under specific conditions. One of these specific conditions can be that deltaP>deltaPmin. In other words, if the change in signals from the primary sensor, or photo sensor for example from an average value of such signals (deltaP) is below a predetermined minimum value (deltaPmin), then the software will bypass the alarm determination routine. This requires that at least a minimum level of change in photo signals must be present in order to determine an alarm condition.

FIG. 1 illustrates a system 10 in accordance with the invention. The system 10 includes a plurality of detectors D1, D2 . . . Dm which can be in wired or wireless communication via a medium such as medium 14 with a common monitoring system control unit 18. The control unit 18 could be implemented with one or more programmable processors as well as associated system software. The monitoring system 18 also includes a plurality of alarm indicating output devices 20 as would be understood by those of skill in the art.

The members of the plurality Di are substantially identical and a discussion of detector D1 will suffice as a description of other members of the plurality. The detector D1 is carried in a housing 26 which could be installed anywhere in a region R being monitored. Detector D1 includes a plurality of ambient condition sensors 30. The sensors 30 include a primary sensor Sp, and one or more secondary sensors S1, S2 . . . Sn. The sensors 30 can be selected from a class which includes photoelectric smoke sensors, ionization-type smoke sensors, infrared fire sensors, gas sensors (such as carbon monoxide sensors), thermal sensors all without limitation. Signals 32 from the sensors 30 can be coupled to local control circuitry 34 in housing 26.

Control circuitry 34 could be implemented with a programmable processor 34*a* and associated control software 34*b*. Those of skill will understand that the details of processor 34*a* and control software 34*b*, except as described subsequently, are not limitations of the present invention. The detectors Di, such as detector D1, can communicate via wired or wireless interface circuitry 40 via the medium 14 which could be both wired and wireless (with the monitoring system 18).

The control circuitry 34*b* can include processing functionality to evaluate a cross-correlation function based on outputs or signals from the secondary sensors, S1, S2 . . . Sn. The cross-correlation function which can incorporate combining output signals from the secondary sensors, such as S1 and S2 by multiplication or addition, can subsequently used to change a threshold value to which an output signal from the primary sensor Sp is compared.

Alternately, in a two sensor detector, one primary sensor and one secondary sensor, the cross-correlation processing can be carried out relative to two signals.

Those of skill in the art will understand that the above-described processing can be carried out solely within each of the detectors Di, entirely at the monitoring system 18, or, partially at the respective detector and partially at the monitoring system 18 all without limitation. It will also understand that the monitoring system 18 can download on a dynamic basis via the medium 14, commands or additional control software to modify the cross-correlation processing in response to signal values being received from one or more of the sensors 30.

By way of example and without limitation, the outputs from the primary sensor Sp, which could be a photoelectric sensor, can be compared to dynamically altered alarm threshold values based on processed outputs of one or more of the secondary sensors such as thermal sensors, gas sensors or infrared sensors. In this regard, a fire which is generating gas, producing increased temperature and emitting infrared radiation, can result in the processing, carried out for example, at detector D1 via control software 34*b* to reduce the sensitivity of the primary sensor to a relatively low value of 0.2%/ft from a normal value of 3%/ft for conditions that do not generate those increased levels of gas, temperature or infrared radiation. This substantially shortens the time period for detection of such fires.

Figure 2:
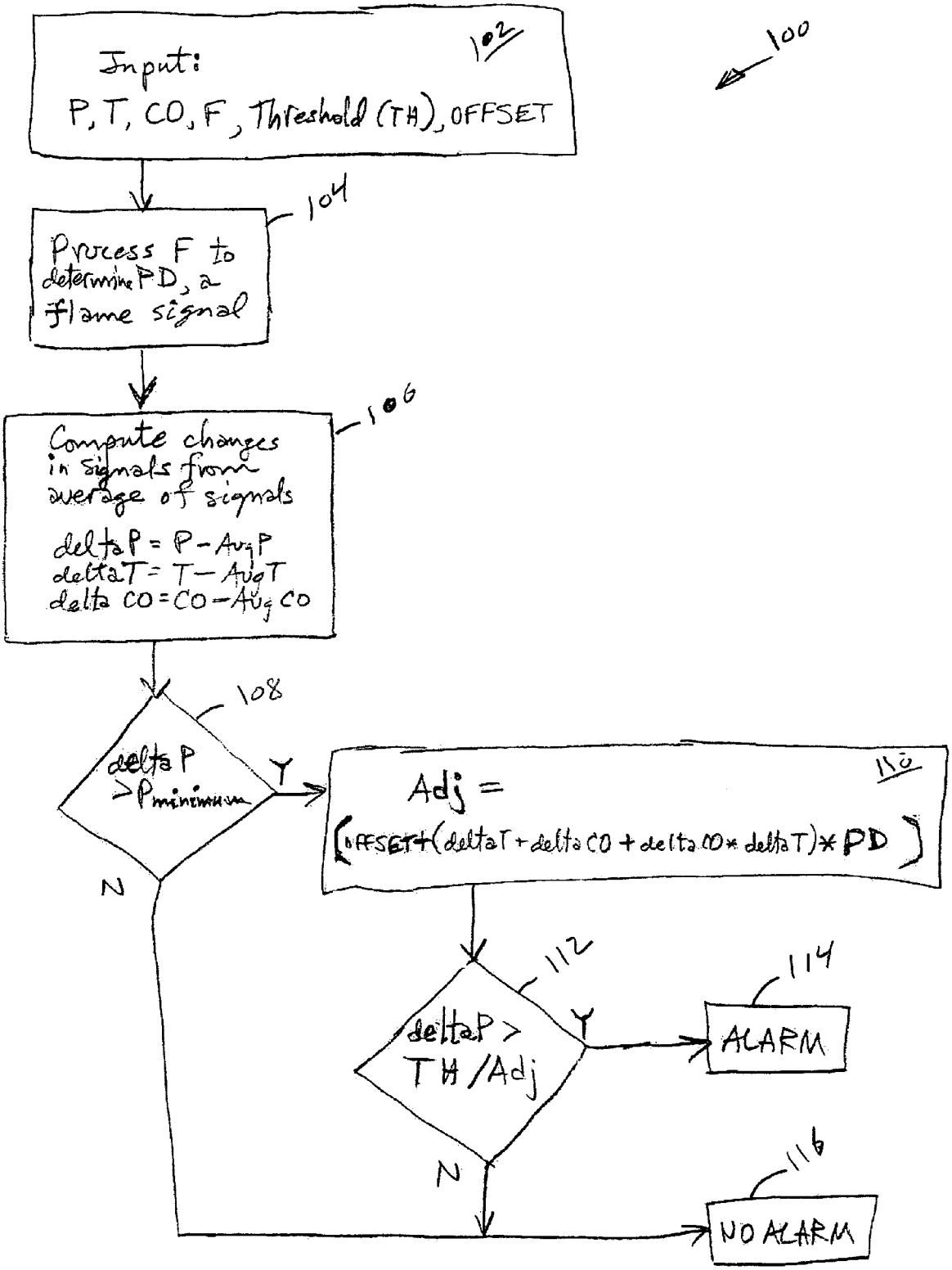
FIG. 2 is a flow diagram of representative signal processing.

FIG. 2 illustrates a flow diagram of a process 100 which could be carried out locally at the respective detector Di, as discussed above. The processing 100 reflects a detector which incorporates as a primary sensor, a photoelectric sensor (P) and three secondary sensors, S1, S2, S3, a thermal sensor with an output T, a carbon monoxide sensor with an output CO and a flame sensor with an output F.

In a step 102, the control software 34*b* can acquire signal values from the primary sensor Sp, and the secondary sensors S1, S2, S3 of types described above. The control software 34*b* also has available an existing threshold value TH and an OFFSET. In a step 104, the output of the flame sensor F could be processed as would be understood by those of skill in the art to determine a flame related signal PD.

The control software 34*b* can be maintaining running averages of signal values from the primary sensor Sp as well as secondary thermal and gas sensors. In a step 106, the variation from respective average values for the photoelectric sensor, the thermal sensor and the gas sensor, can be determined.

If the variation of the photosensor output from the averaged photosensor output value exceeds a predetermined minimum value, step 108, then in step 110 a cross-correlation adjustment value is established for purposes of modifying the threshold value TH. Executing step 108 minimizes the likelihood of nuisance or false alarms in that the output from the primary sensor Sp is required to vary from its running average by the predetermined amount before an alarm determination is carried out.

In the presence of a significant enough variation of the signal from the primary sensor from its average value, an adjustment value is established as illustrated in step 110. In a step 112 the variation of the primary sensor Sp is compared to an adjusted threshold value.

If the variation in signal from the primary sensor from its average value, exceeds the adjusted threshold value, an alarm condition is indicated, step 114. The alarm condition can be forwarded via medium 14 to the monitoring system 18 for further processing and generation of alarm indicating outputs as needed. Alternately, where no alarm condition has been established, step 116, the control software 34*b* continues evaluating outputs from the detectors 30.

Figure 3:
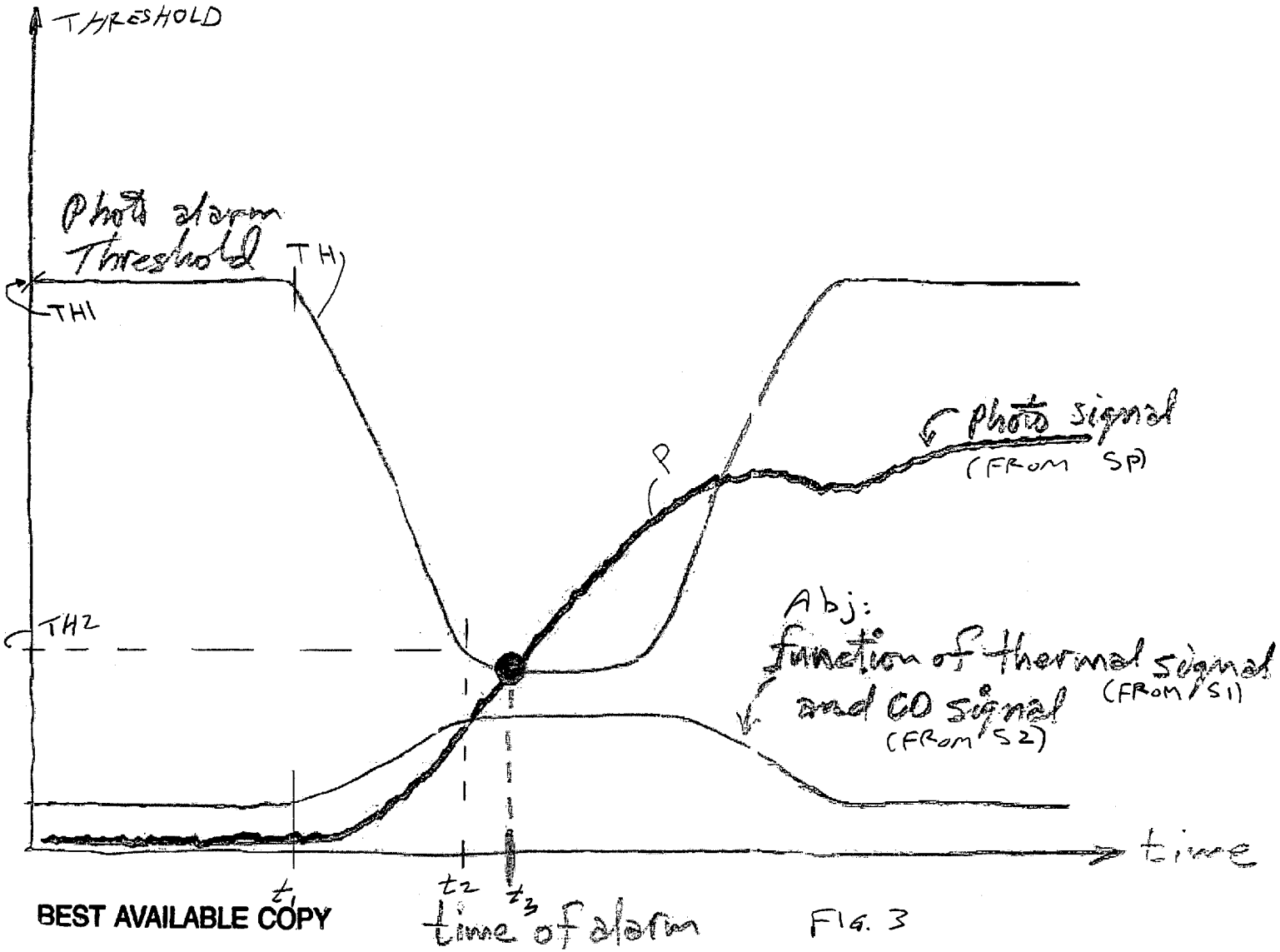
FIG. 3 is a graph illustrating promising results.

FIG. 3 is a graph illustrating some of the aspects of the results of the method 100. As illustrated in FIG. 3, prior to time t1, the alarm threshold TH associated with the primary sensor Sp was substantially constant at TH1. At time t1, the output signal from the primary sensor Sp, as well as the output signals from the secondary sensors, thermal sensor S1, and gas sensor S2 all start to increase. As a result of the processing, particularly steps 110, 112 of method 100, the threshold value for the primary sensor falls from the initial TH1 to a lesser value TH2 in response to the increase in value of the adj function.

Between time t2 and t3 the value of the output signal P from the primary sensor continues to increase. At time t3 it crosses the reduced alarm threshold, thereby producing an alarm condition, step 114. The time to entering an alarm state, step 114, can thus be substantially shortened in comparison to a condition where the alarm threshold is not altered. Additionally, because the adjustment function Adj responds to at least the thermal signals and gas signals from the respective secondary sensors, these provide supporting indicia that an ongoing fire process may well be present and developing as opposed to a false alarm.

Those of skill will understand that variations in the above described processing could be implemented without departing from the spirit and scope of the present invention. For example, only one secondary sensor could be utilized in establishing an adjustment value. Alternately, two or more secondary sensors could be used all without departing from the spirit and scope of the present invention. Other forms of sensors which are indicative of dangerous conditions could also be incorporated into the respective detectors and processing also without departing from the spirit and scope of the present invention. It will also be understood that instead of decreasing, the processing results could increase the threshold value.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed:

1. A detector comprising:

at least three different ambient condition sensors, one of the sensors is a primary condition sensor, the others are secondary condition sensors, all of the sensors produce respective condition indicating outputs;

control circuitry which defines a time variable alarm threshold for the primary condition sensor, the control circuitry is responsive to outputs from the two secondary sensors to form a cross-correlated threshold adjusting indicium, the control circuitry including further circuitry to adjust the time variable alarm threshold in accordance with the indicium; and alarm determination circuitry responsive to the adjusted time variable threshold.

2. A detector as in claim 1 which includes circuitry for forming a running average of at least the output of the primary sensor where a current representation of the output of the primary sensor must exceed a current average value by a predetermined amount prior to determining if an alarm condition is present.

3. A detector as in claim 1 where the control circuitry carries out a multiplication of representations of signals from the secondary condition sensors in forming the threshold adjusting indicium.

4. A detector as in claim 3 where the control circuitry divides the time variable alarm threshold by the threshold adjusting indicium.

5. A detector as in claim 1 where the control circuitry includes a programmable processor and associated instructions.

6. A detector as in claim 5 where first instructions form the cross-correlated threshold adjusting indicium.

7. A detector as in claim 6 where second instructions adjust the time variable threshold.

8. A detector as in claim 7 where the second instructions divide a representation of the alarm threshold by the indicium.

9. A detector as in claim 8 which includes third instructions, responsive to the divided representation of the alarm threshold to make an alarm determination.

10. A system comprising:

first software recorded on a computer readable medium for responding to received first and second signals, each indicative of a respective ambient condition, to form a cross correlated threshold adjusting indicium;

second software for carrying out a predetermined function, responsive to the indicium, for adjusting a threshold associated with a third sensor.

11. A system as in claim 10 which includes at least first, second, and third different ambient condition sensors.

12. A system as in claim 11 which includes software for maintaining a running average of at least some of the sensor output signals.

13. A system as in claim 12 which includes software to compare a current sensor output value, from the third sensor, to a respective running average,and, further software to compare a representation of the current sensor output value from the third sensor to the adjusted threshold value of the third sensor only if the current sensor value varies from the respective running average by at least a predetermined amount.

14. A system as in claim 13 where the first software forms the cross-correlation indicium by multiplying signal values, associated with the first and second sensors, together.

15. A system as in claim 14 which includes interface related software to receive at least the first and second software from a displaced source.

16. A system as in claim 15 where the first and second sensors are selected from a class that includes at least a thermal sensor, a gas sensor, an infrared sensor, a smoke sensor and a flame sensor.

17. A system as in claim 16 where the first software determines if the threshold adjusting indicium exceeds a predetermined value prior to the second software carrying out the predetermined function.

18. A system as in claim 17 which includes a plurality of displaced sets of first and second software.

19. A fire alarm system comprising:

at least three sensors, the sensors each generating signals indicative of a respective environmental condition being monitored, where one of the sensors is selected to be a first sensor generating a first sensor signal and the remaining at least second and third sensors generating at least second and third sensor signals respectively; and circuitry where the at least second and third sensor signals are combined to form an adjustment function, the adjustment function is used by the circuitry to alter a threshold value, where the first sensor signal is compared to the altered threshold value and an alarm condition is indicated if the first sensor signal crosses the altered threshold value.

20. A system as in claim 19 where the relationship of the at least second and third sensor signals includes a multiplication of representations of the at least second and third sensor signals.

21. A system as in claim 19 where the relationship of the remaining sensor signals includes an addition of representations of at least the second and third sensor signals.

22. A system as in claim 20 where the representations comprise a change in sensor signal value from an average sensor signal value.

23. A system as in claim 21 where the representations comprise a change in sensor signal value from an average sensor signal value.

24. A system as in claim 20 where the representations comprise a rate of change per time of at least one sensor signal.

25. A system as in claim 22 where the representations comprise a rate of change per time of at least one sensor signal.

26. A system as in claim 19 where the adjustment function includes a value that changes if at least one sensor is determined to have changed its sensitivity to the environmental condition being monitored.

* * * * *